US006536526B2

(12) United States Patent
Cox

(10) Patent No.: US 6,536,526 B2
(45) Date of Patent: Mar. 25, 2003

(54) METHOD FOR DECREASING HEAT TRANSFER FROM PRODUCTION TUBING

(75) Inventor: Don C. Cox, Roanoke, TX (US)

(73) Assignee: Baker Hughes Incorporated, Houston, TX (US)

( * ) Notice: Subject to any disclaimer, the term of this patent is extended or adjusted under 35 U.S.C. 154(b) by 25 days.

(21) Appl. No.: 09/824,283

(22) Filed: Apr. 2, 2001

(65) Prior Publication Data

US 2002/0139533 A1 Oct. 3, 2002

(51) Int. Cl.[7] ..... E21B 36/04; E21B 43/24

(52) U.S. Cl. ..... 166/302; 166/60; 166/248; 175/17

(58) Field of Search ..... 166/248, 57, 60, 166/65.1, 302; 175/17, 16

(56) References Cited

U.S. PATENT DOCUMENTS

| | | | | |
|---|---|---|---|---|
| 3,397,745 A | | 8/1968 | Owens et al. | 166/57 |
| 3,680,631 A | | 8/1972 | Allen et al. | 166/57 |
| 3,720,267 A | | 3/1973 | Allen et al. | 166/314 |
| 3,763,935 A | | 10/1973 | Perkins | 166/315 |
| 3,820,605 A | | 6/1974 | Barber et al. | 166/315 |
| 3,861,469 A | | 1/1975 | Bayless et al. | 166/303 |
| 4,024,919 A | | 5/1977 | Pujol | 166/303 |
| 4,116,275 A | | 9/1978 | Butler et al. | 166/303 |
| 4,258,791 A | | 3/1981 | Brandt et al. | 166/302 |
| 4,276,936 A | | 7/1981 | McKinzie | 166/303 |
| 4,296,814 A | | 10/1981 | Stalder et al. | 166/303 |
| 4,480,695 A | | 11/1984 | Anderson | 166/303 |
| 4,496,001 A | * | 1/1985 | Sigworth, Jr. | 166/303 |
| 4,951,748 A | * | 8/1990 | Gill et al. | 166/248 |
| 5,070,533 A | * | 12/1991 | Bridges et al. | 166/60 |
| 5,535,825 A | | 7/1996 | Hickerson | 166/302 |
| 5,620,048 A | | 4/1997 | Beauquin | 166/62 |
| 5,782,301 A | | 7/1998 | Neuroth et al. | 166/302 |
| 2002/0023751 A1 | * | 2/2002 | Neuroth et al. | 166/302 |

* cited by examiner

*Primary Examiner*—David Bagnell
*Assistant Examiner*—Jennifer H Gay
(74) *Attorney, Agent, or Firm*—Bracewell & Patterson, L.L.P.

(57) ABSTRACT

A method for retarding temperature loss of fluid being produced in a well employs a fluid of low thermal conductivity in the tubing annulus. The tubing annulus extends between the production casing and the production tubing. It extends from a packer at the lower end of the tubing annulus to a wellhead. The fluid in one case is low density gas created by a partial vacuum. A vacuum is drawn on the tubing annulus to reduce the air density, which in turn reduces the amount of heat that convection currents can carry. In another example, the tubing annulus fluid is viscous hydrocarbon liquid. The hydrocarbon liquid also has a low thermal conductivity. Heat is supplied to the fluids being produced through the tubing annulus by a heater cable that extends into the well.

13 Claims, 2 Drawing Sheets

Fig. 1
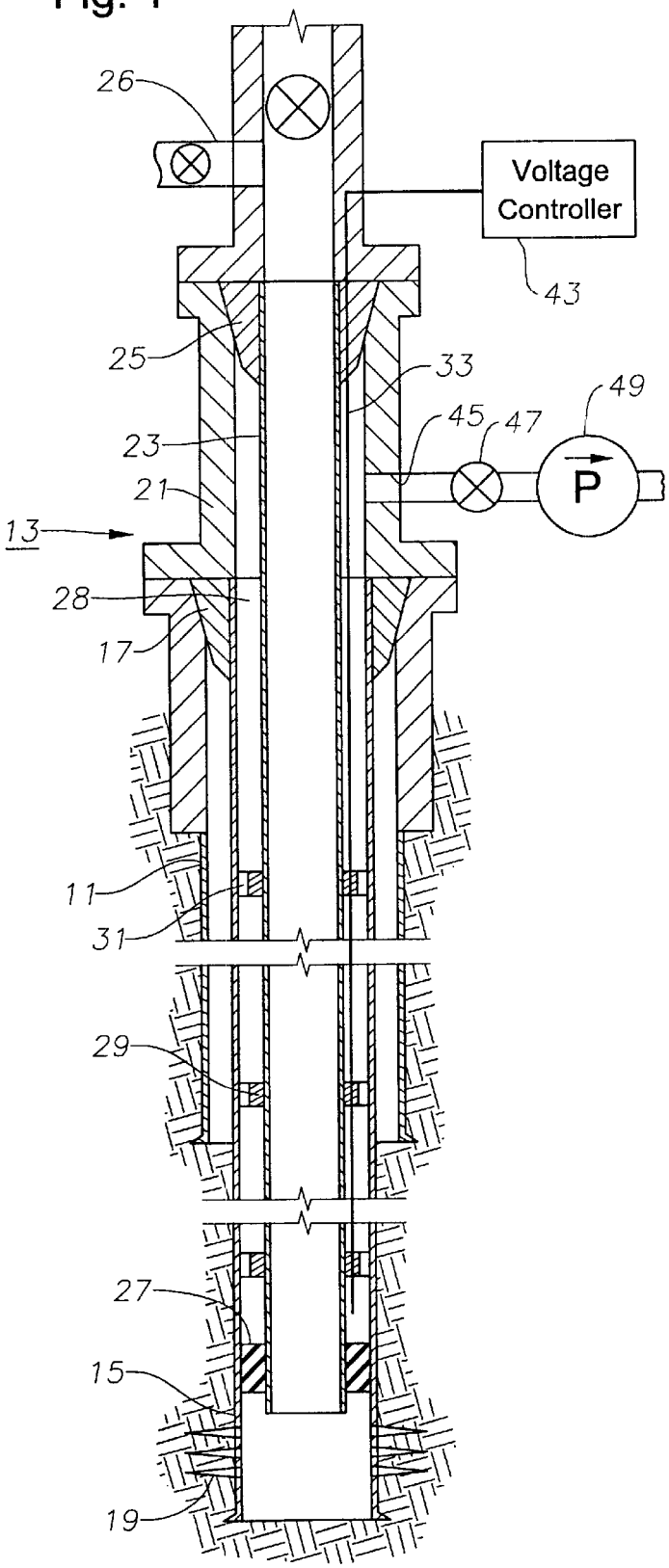
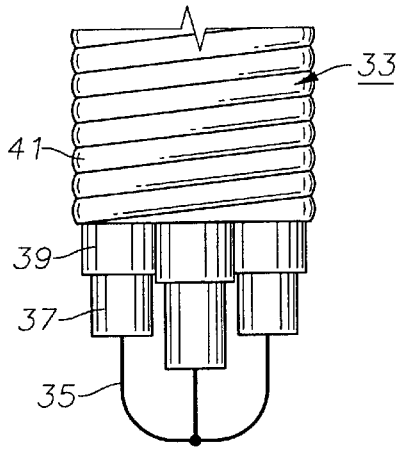
Fig. 2

METHOD FOR DECREASING HEAT TRANSFER FROM PRODUCTION TUBING

FIELD OF THE INVENTION

This invention relates in general to a method for decreasing heat transfer from production of a well to the geological formation into which the well bore extends.

BACKGROUND OF THE INVENTION

An oil or gas well normally has one or more strings of casing extending into a well that are cemented in place. The production casing is perforated in an earth formation bearing hydrocarbons. A string of production tubing extends into the production casing. Often, a packer will seal the lower end of the tubing to the production casing at a point above the perforations. Oil and/or gas is produced through the production tubing to the surface.

In arctic regions, a cold permafrost formation layer often extends to depths of 2,000 feet below the surface. Liquids and gases passing through this cold layer may be cooled to the point that viscosity increases and hydrates and condensates begin to form. Water freezing can result, restricting well production.

In temperate zone gas wells, gas expansion through downhole chokes can result in lowering gas temperatures to the level that some of the same problems encountered in arctic wells began to appear. In low pressure, wet gas wells, condensation can form suspended slugs of condensate within the production tubing or casing annulus. This condensate significantly reduces the well's production.

It is known that heating the liquid or gas flowing through the production tubing can retard the undesirable effects mentioned above. One heating device uses resistance type electrical cable suspended within the production tubing or strapped to the outside diameter of the production tubing. While such will retard the cooling of the liquid, much of the heat will be lost through the tubing annulus to the geological formation. This lost heat is not available to increase the temperature of the produced liquid or gas and significantly increases heating costs. It is also known to thermally insulate at least portions of the production tubing in various manners to retard heat loss, however improvements are desired.

SUMMARY OF THE INVENTION

In this invention, temperature loss of fluid being produced in a well is reduced by providing a fluid of low thermal conductivity in the tubing annulus. The tubing annulus extends radially between the casing and the production tubing and axially from a packer just above the perforations to the wellhead. In one method, the low thermal conductivity fluid is provided by drawing at least a partial vacuum on the tubing annulus. This reduces the amount of air left in the tubing annulus, thereby lowering the thermal conductivity. Preferably about 27" to 29" of vacuum is drawn on the tubing annulus.

In another aspect of the invention, providing low thermal conductivity fluid in the tubing annulus is accomplished by substantially filling the tubing annulus with a hydrocarbon liquid. The hydrocarbon liquid should be viscous, preferably at least 1,000 centipoise at 100° F. Also, preferably the tubing is centered in the well with a plurality of centralizers that extend between the casing and the tubing.

BRIEF DESCRIPTION OF THE DRAWINGS

FIG. 1 is a schematic sectional view of a well constructed in accordance with this invention.

FIG. 2 is an enlarged partial view of the lower end of heater cable employed in FIG. 1.

DESCRIPTION OF THE PREFERRED EMBODIMENTS

Figure 3:
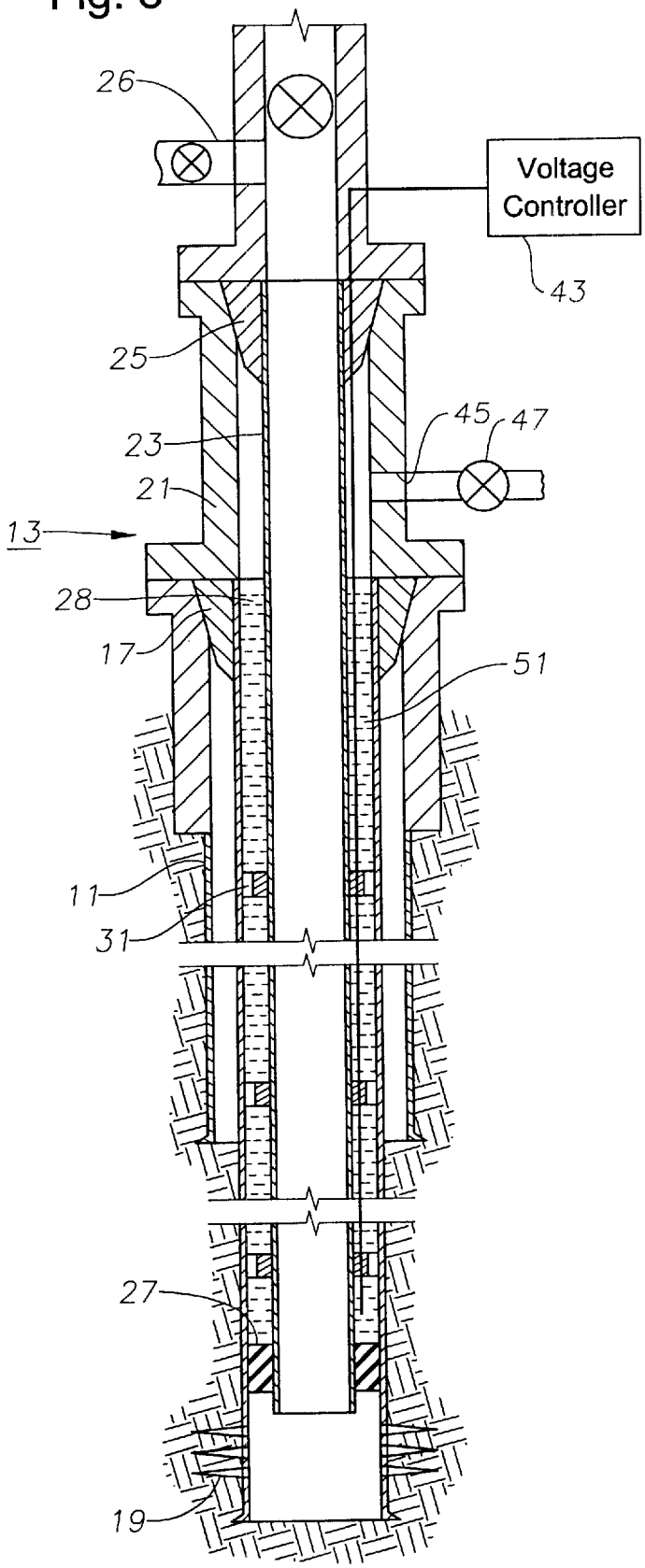
FIG. 3 is a sectional view of the well of FIG. 1, shown with a liquid hydrocarbon contained in the tubing annulus.

Referring to FIG. 1, the well has a first set of casing or conductor pipe 11 that extends into the well to a first depth. The well is then drilled deeper and production casing 15 will be installed. Production casing 15 is cemented in place and is suspended in the wellhead 13 by a casing hanger 17. Casing hanger 17 also seals the annulus surrounding production casing 15. In deeper wells, there will be at least two strings of casing, with the final string of casing being considered the production casing. The production casing 15 is perforated to form perforations 19 through casing 15 into the earth formation for producing well fluids.

Wellhead 13 includes a tubular head or member 21, which provides support for a string of production tubing 23. Tubing 23 is normally made up of sections of conduit secured together and extending into the well, although continuous coiled tubing may also be used. Tubing 23 is supported by a tubing hanger 25 in tubing head 21. Tubing hanger 25 also seals tubing 23 to tubing head 21. Wellhead 11 has an outlet 26 for the flow of well fluid from production tubing 23. In some wells, tubing hanger 25 may be supported by casing hanger 17, rather than by tubing head 21.

A packer 27 seals between tubing 23 and casing 15 near the lower end of tubing 23. Packer 27 will be spaced above perforations 15. A tubing annulus 28 extends radially from tubing 23 to casing 15 and axially from packer 27 to tubing hanger 25. Tubing 23 is preferably centered within casing 15 on the longitudinal axis of casing 15. The centering is accomplished by a plurality of centralizers 29 spaced along the length of tubing 23. Each centralizer 29 may be an elastomeric annular member that has holes or channels 31 extending through it so as to allow fluid communication above and below each centralizer 29. Alternately each centralizer 29 maybe a steel bow spring type of conventional design.

A heater cable 33 is used to heat well fluid flowing up production tubing 23. In this embodiment, heater cable 33 extends alongside tubing 23 and is strapped to it at regular intervals. Alternately, heater cable 33 could be contained in coiled tubing and lowered into production tubing 23. Heater cable 33 has at least one wire for generating heat when voltage is applied. Preferably, heater cable 33 is constructed as shown in U.S. Pat. No. 5,782,301, Neuroth et al., all of which materials hereby is incorporated by reference. As explained in that patent, heater cable 33 preferably has three conductors 35 of low resistivity. Conductors 35 are coated with insulation layers 37, which are surrounded by extruded metal sheaths 39, preferably of lead. A metal armor 41 wraps around the assembly of the three insulated and sheathed conductors. Conductors 35 are connected together at the lower end. A voltage controller 43 located at the surface supplies three phase AC power to heater cable 33, causing it to generate heat.

Wellhead 13 has a tubing annulus port 45 with a valve 47 for selectively opening and closing communication with tubing annulus 28. In the embodiment of FIG. 1, a vacuum pump 49 is connected by a conduit to tubing annulus port 45. Vacuum pump 45 is preferably an electrically driven conventional vacuum pump. Tubing annulus 28 will be free of any liquids. Vacuum pump 49 will evacuate the air and/or other gasses within tubing annulus 28 to a desired vacuum level. In one example, the vacuum level is about 27" to 29". For a 6,000 ft. well, a vacuum pump driven by a 1 hp electrical motor is able to accomplish a vacuum of this level in about 30 minutes of running time. It is desirable for the vacuum pump 49 to have a sensor that measures the vacuum and periodically turns on vacuum pump 49 should the vacuum decline below a minimum level.

In the operation of the first embodiment, heater cable 33 will be strapped to tubing 23 and lowered into the well while tubing 23 is lowered into the well. Packer 27 will be set, defining the lower end of tubing annulus 28. Vacuum pump 49 will operate to lower the pressure of the air and/or other gasses within tubing annulus 28 to that less than the atmospheric pressure at wellhead 13. Three phase power is supplied to heater cable 33 to generate heat. Heat is generated continuously throughout the entire length of heater cable 33.

The low pressure gas in tubing annulus 28 has less density than if at atmospheric or higher pressure. This reduces the amount of heat that convection currents can carry, reducing convection heat transfer. Low pressure gasses may not be opaque to thermal radiation depending upon the gas and the gas temperature. However, typical electrical heater cable applications in wells operate at temperatures low enough that thermal radiation is a minor factor in heat transfer to the formation. The partial vacuum in tubing annulus 28 retards cooling of well fluid flowing out perforations 19 and up tubing 23.

In the embodiment of FIG. 3, the same numerals are employed for common components. Rather than evacuating tubing annulus 28, however, a hydrocarbon liquid 51 is placed in tubing annulus 28. Preferably, liquid 51 substantially fills tubing annulus 28. It may be filled by opening a sliding sleeve (not shown) in tubing 23 above packer 27, then circulating hydrocarbon liquid 51 down tubing annulus 28, with displaced fluid flowing up tubing 23. The sleeve may then be closed by a wireline tool in a conventional manner. The viscosity of hydrocarbon liquid 51 should be fairly high, although it must not be so high so as to prevent it from being pumped. Preferably the viscosity is at least 1,000 centipoise at 100° F. Hydrocarbon liquid 51 may be a crude oil or a refined petroleum product. Hydrocarbon liquid greatly reduces convection currents and has poor thermal conductivity. Such liquids are also opaque to thermal radiation, blocking heat transfer by that means.

The invention has significant advantages. The low thermal conductivity of the annulus fluid is readily provided, in one case, by low density gasses created by a partial vacuum, and in another case, by a hydrocarbon liquid. This thermal insulation of the tubing annulus reduces the cooling of well fluid being produced through the tubing, avoiding problems that exist in permafrost regions. It also reduces the cooling of flowing wet gas, retarding the creation of slugs of condensate within the production tubing.

While the invention has been shown in only two of its forms, it should be apparent to those skilled in the art that it is not so limited but is susceptible to various changes without departing from the scope of the invention.

I claim:

1. A method of retarding temperature loss of fluid being produced in a well having a conduit, a set of perforations in the well into an earth formation, and a string of production tubing extending through the conduit and sealed by a packer to the conduit above the perforations, the method comprising:

(a) placing a cable having at least one electrical conductor into the well;

(b) providing a fluid of low thermal conductivity throughout a tubing annulus that extends axially from the packer to a wellhead and extends radially from the tubing to the casing;

(c) applying electrical power to the cable to cause heat to be generated along at least a substantial portion of the length of the cable for heating the tubing; and (d) flowing well fluid through the perforations and up the production tubing.

2. The method according to claim 1, wherein step (b) comprises:

removing substantially all liquids from the tubing annulus; and reducing a pressure of gas contained in the tubing annulus to below atmospheric pressure that exists at the wellhead.

3. The method according to claim 1, wherein step (b) comprises:

placing a hydocarbon liquid in the tubing annulus.

4. The method according to claim 1, wherein step (b) comprises:

filling the tubing annulus with a hydrocarbon liquid having a viscosity of at least 1000 centipoise at 100 degrees F.

5. The method according to claim 1, further comprising:

centering the tubing in the well with a plurality of centrilizers extending between the conduit and the tubing.

6. A method of producing fluid from a well having a conduit and a set of perforations in the well into an earth formation, the method comprising:

(a) lowering a string of production tubing into the conduit and sealing the tubing to the conduit with a packer above the perforations, defining a tubing annulus that extends radially from the tubing to the conduit and axially from the packer to a wellhead;

(b) lowering a cable having a plurality of conductors into the well;

(c) flowing well fluid through the perforations and up through the tubing;

(d) applying electrical power to the conductors to cause heat to be emitted continuously along at least a substantial length of the cable for retarding cooling of the well fluid as the well fluid flows up the tubing; and (e) reducing pressure of gas existing throughout the tubing annulus to less than atmospheric pressure that exists at the wellhead to retard loss of heat through the conduit.

7. The method according to claim 6, where step (e) is performed with a vacuum pump placed in communication with the tubing annulus.

8. The method according to claim 6, wherein step (a) further comprises centering the tubing in the well with a plurality of centrilizers extending between the conduit and the tubing.

9. The method according to claim 6, wherein step (b) is performed by strapping the power cable to the tubing while lowering the tubing into the well.

10. A method of producing fluid in a well having a conduit and a set of perforations through the in the well into an earth formation, the method comprising:

(a) lowering a string of production tubing into the conduit and sealing the tubing to the conduit with a packer above the perforations, defining a tubing annulus that extends radially from the tubing to the conduit and axially from the packer to a wellhead;

(b) lowering a cable having a plurality of conductors into the well;

(c) flowing well fluid through the perforations and up through the production tubing;

(d) applying electrical power to the conductors to generate heat continuously along at least a substantial portion of the length of the cable for retarding heat loss of the well fluid as the well fluid flows up the tubing; and (e) substantially filling the tubing annulus with a hydocarbon liquid to retard loss of heat through the conduit.

11. The method according to claim 10, wherein step (e) comprises providing the hydrocarbon liquid with a viscosity of at least 1000 centipoise at 100 degrees F.

12. The method according to claim 10, wherein step (a) further comprises centering the tubing in the well with a plurality of centrilizers extending between the conduit and the tubing.

13. The method according to claim 10, wherein step (b) comprises strapping the cable to the tubing and lowering the cable into the conduit while lowering the tubing into the conduit.

* * * * *